US007441500B2

(12) United States Patent
Kim

(10) Patent No.: US 7,441,500 B2
(45) Date of Patent: Oct. 28, 2008

(54) METHOD FOR FORMING PRINTING ROLL PATTERNS

(75) Inventor: Chul-Ho Kim, Inchuon (KR)

(73) Assignee: LG Display Co., Ltd., Seoul (KR)

( * ) Notice: Subject to any disclaimer, the term of this patent is extended or adjusted under 35 U.S.C. 154(b) by 336 days.

(21) Appl. No.: 11/118,340

(22) Filed: May 2, 2005

(65) Prior Publication Data

US 2005/0244990 A1 Nov. 3, 2005

(30) Foreign Application Priority Data

Apr. 30, 2004 (KR) ..... 10-2004-0030771

(51) Int. Cl.
*B41F 9/00* (2006.01)

(52) U.S. Cl. ..... 101/170; 101/450.1; 101/483

(58) Field of Classification Search ..... None
See application file for complete search history.

(56) References Cited

U.S. PATENT DOCUMENTS 3,593,661 A * 7/1971 Tripp ..... 101/175
4,281,052 A * 7/1981 Ito et al. ..... 101/467
4,909,151 A * 3/1990 Fukui et al. ..... 101/450.1
5,624,775 A * 4/1997 Carre et al. ..... 101/483
5,863,412 A * 1/1999 Ichinose et al. ..... 205/652
2003/0084796 A1 * 5/2003 Kwon et al. ..... 101/41

FOREIGN PATENT DOCUMENTS

JP 5-11270 A 1/1993
KR 2003-0057067 A 7/2003

* cited by examiner

*Primary Examiner*—Jill E Culler
(74) *Attorney, Agent, or Firm*—Birch, Stewart, Kolasch & Birch, LLP

(57) ABSTRACT

A method for forming a patterns includes applying ink onto an etching object layer; forming ink patterns on the etching object layer as a printing roll having convex patterns thereon rotates on the ink and removes portions of the ink which contact the convex portions of the printing roll, thereby forming ink patterns; and hardening the ink patterns.

15 Claims, 7 Drawing Sheets

METHOD FOR FORMING PRINTING ROLL PATTERNS

This application claims the priority benefit of the Korean Patent Application No. 10-2004-0030771 filed on Apr. 30, 2004, which is hereby incorporated by reference.

BACKGROUND OF THE INVENTION

1. Field of the Invention

The present invention relates to a method for forming a pattern using a printing method, and particularly, to a method for forming a pattern using a printing roll having convex patterns.

2. Description of the Related Art

A display device, especially a flat panel display such as a liquid crystal display (LCD) device, is driven by an active device such as a thin film transistor at each pixel. The driving method is called as an active matrix driving method. According to the active matrix driving method, the active device is arranged at each pixel in a matrix form to drive a corresponding pixel.

FIG. 1 is a view showing an active matrix type LCD device. The LCD device is a TFT LCD device in which a thin film transistor is used as an active device. As shown, at each pixel of the TFT LCD device where N×M pixels are arranged horizontally and vertically, a TFT is formed at the crossing of a gate line 4 to which a scan signal is applied from an external driving circuit and a data line 6 to which an image signal is applied. The TFT includes a gate electrode 3 connected to the gate line 4, a semiconductor layer 8 formed on the gate electrode 3 and activated as a scan signal is applied to the gate electrode 3, and a source/drain electrode 5 formed on the semiconductor layer 8. A pixel electrode 10 is formed at a display region of the pixel 1. The pixel electrode 10 is connected to the source/drain electrode 5 and operates the liquid crystal (not shown) by receiving an image signal through the source/drain electrode 5 as the semiconductor layer 8 is activated.

FIG. 2 is a view showing a structure of a TFT arranged at each pixel. As shown, the TFT includes a substrate 20 formed of a transparent insulating material such as glass, a gate electrode 3 formed on the substrate 20, a gate insulating layer 22 formed on the entire surface of the substrate 20 on which the gate electrode 3 is formed, a semiconductor layer 8 formed on the gate insulating layer 22 and activated as a signal is applied to the gate electrode 3, a source/drain electrode 5 formed on the semiconductor layer, and a passivation layer 25 formed on the source/drain electrode 5 for protecting the device.

The source/drain electrode 5 of the TFT is electrically connected to a pixel electrode formed in a pixel, and displays an image by driving the liquid crystal as a signal is applied to the pixel electrode through the source/drain electrode 5.

In the active matrix type LCD device, each pixel has a size corresponding to several tens of μm. Accordingly, the active device such as the TFT arranged in the pixel has to have a minute size corresponding to several μm. Moreover, as the consumer's demand for a display device of a high image quality such as an HDTV is increased, more pixels have to be arranged on a screen of the same area. Accordingly, an active device pattern arranged in each pixel (including a gate line pattern and a data line pattern) has to also be formed to have a minute size.

In order to fabricate an active device such as a TFT according to the related art, a pattern, a line, etc. of the active device are formed by a photolithography process by an exposing device. However, the photolithography process is composed of a series of processes such as a photoresist deposition, an alignment process, an exposure process, a develop process, a cleaning process, etc.

Also, a plurality of photolithography processes should be repetitively performed to form the pattern for the LCD device, thereby reducing productivity.

SUMMARY OF THE INVENTION

Therefore, an object of the present invention is to provide a method for forming a pattern so as to improve productivity by forming patterns through one process using a printing method.

Another object of the present invention is to provide a method for forming a pattern so as to simplify a printing process.

Still another object of the present invention is to provide a method for forming a pattern so as to improve thickness uniformity of the pattern.

To achieve these and other advantages and in accordance with one purpose of the present invention, as embodied and broadly described herein, there is provided a method for forming a pattern, comprising: applying ink onto an etching object layer; forming ink patterns on the etching object layer as a printing roll having convex patterns rotates on the ink in contact therewith; and hardening the ink patterns.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

A gravure offset printing process, in which ink is applied onto a concave plate and surplus ink is etched for printing, may be used in various fields such as a printing for publication, or printing on packages, cellophane, vinyl and polyethylene. In the gravure offset printing, the ink is transferred onto a substrate by using a printing roll. Thus, a pattern can be formed by a single transfer even in a large-sized display device by using a printing roll corresponding to an area of a desired display device. The gravure offset printing may be used to form various kinds of patterns of the display device, for example, not only a TFT but also metal patterns for a capacitor and for a gate line, a data line and a pixel electrode connected to the TFT of an LCD device.

Figure 1:
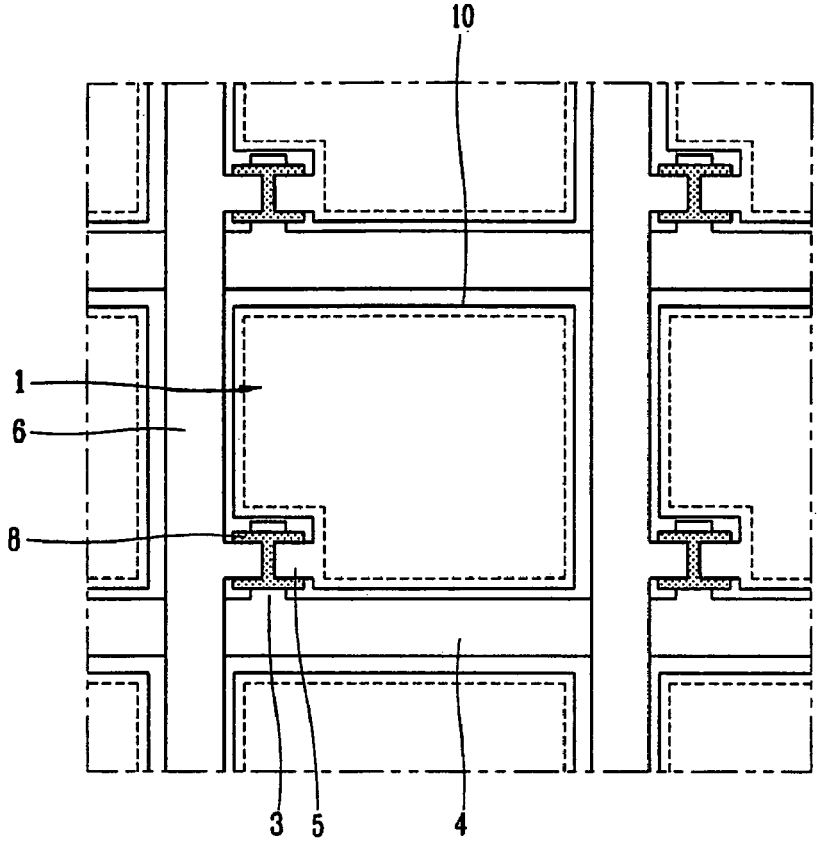
FIG. 1 RELATED ART
FIG. 1 is a plan view illustrating a related art LCD device.
Figure 2:
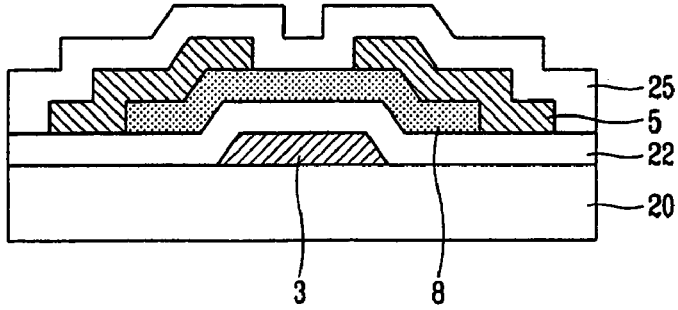
FIG. 2 RELATED ART
FIG. 2 is a cross-sectional view illustrating a TFT of the LCD device of FIG. 1.
Figure 3A:
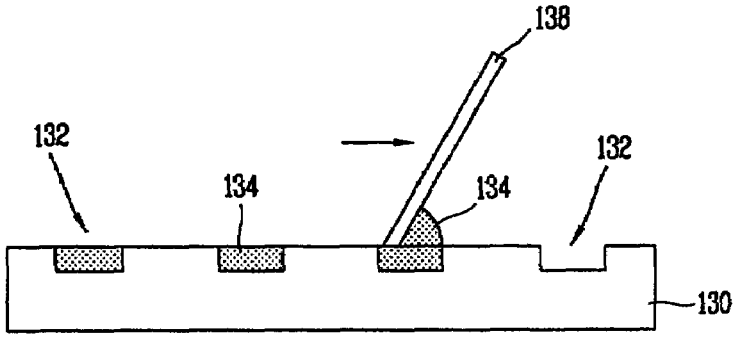
FIGS. 3A to 3C are views illustrating a method for forming a pattern using a gravure offset printing method.
Figure 3B:
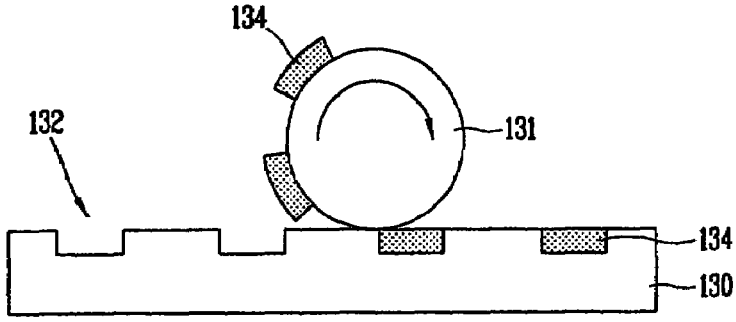
Figure 3C:
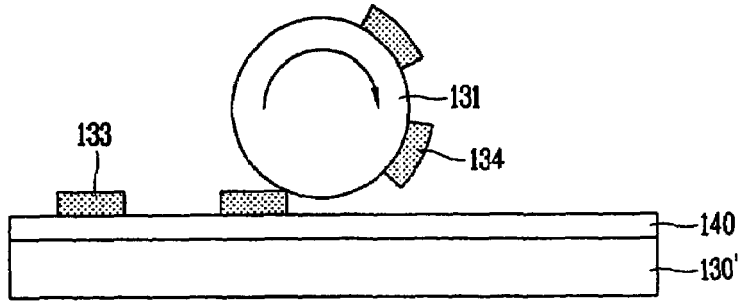

FIGS. 3A to 3C are schematic views illustrating a method for forming ink patterns on a substrate by using a printing method. As shown in FIG. 3A, in the printing method, grooves 132 are formed at specific locations of a concave plate or a cliché 130 and then are filled with ink 134. The grooves 132 are formed at the cliché 130 by a general photolithography process, and the filling of the ink 134 into the grooves 132 is performed by applying pattern forming ink 134 to an upper portion of the cliché 130 and then pushing a doctor blade 108 across a surface of the cliché 130. Accordingly, as the doctor blade 138 progresses, the grooves 132 are filled with ink 134 and simultaneously, the surplus ink remaining on the surface of the cliché 130 is removed therefrom.

As shown in FIG. 3B, the ink 134 filled in the grooves 132 of the cliché 130 is transferred to a surface of a printing roll 131 which rotates across a surface of the cliche 130 in contact therewith. The printing roll 131 has the same width as that of a panel of a display device to be fabricated, and has the same circumference as that of a length of the panel. Accordingly, the ink 134 filled in the grooves 132 of the cliché 130 is transferred onto a circumferential surface of the printing roll 131 by a single rotation.

Then, as shown in FIG. 3C, as the printing roll 131 rotates across a surface of an etching object layer 140 formed on a substrate 130' in contact therewith, the ink 134 having transferred to the printing roll 131 is transferred to the etching object layer 140. Then, the transferred ink may be UV-irradiated or heated to be dried to form ink patterns. Desired patterns 133 may be formed over an entire substrate 130' of the display device by a single rotation of the printing roll 131. Then, the etching object layer 140 is etched by using the ink patterns 133 as a mask, thereby forming desired patterns.

As mentioned above, in the printing method, the cliché 130 and the printing roll 131 may be fabricated according to a desired size of a display device, and patterns may be formed on the substrate 130' by a single transfer. Thus, patterns for a large-sized display device may be formed through one process.

The etching object layer 140 may be a metal layer for forming a metal pattern for, for example, a gate electrode, source/drain electrodes of a TFT, a gate line, a data line or a pixel electrode, or a semiconductor layer for forming an active layer. Also, the etching object layer 140 may be an insulating layer formed of, for example, SiOx or SiNx.

In forming a pattern of the display device, the ink patterns 133 function as a resist functions in a photolithography process. Accordingly, the ink patterns 133 are formed on the metal layer or the insulating layer, and then the metal layer or the insulating layer is etched by a general etching process, thereby forming a metal layer (i.e., electrode structure) or an insulating layer (e.g., contact hole) having a desired pattern.

The printing method has many advantages in that the ink patterns for a large-sized display device may be formed by a single printing process and its process is very simple compared to the photolithography process.

However, since such a printing method undesirably has poor accuracy as compared to the photolithography process, alignment of the patterns may not be accurately made, thereby causing productivity reduction owing to defective patterns.

In the present invention, a printing method is used to form circuit patterns or patterns for an active device of a display device such as an LCD device.

In accordance with one aspect of the present invention, such problems may be resolved by forming patterns on the printing roll 134 itself to allow the printing roll 131 to function as a concave plate such as the cliché 130 without using the concave plate. Namely, ink is applied onto a substrate, and convex patterns are formed on the printing roll 131 itself. Then, the printing roll immediately contacts with the ink that has been applied onto the substrate 140 and rotates across a surface of the ink, applying constant pressure thereto, so that the ink contacting with the convex patterns is detached from the substrate. Accordingly, the ink patterns selectively remain on an etching object layer of the substrate, and the substrate is etched by using the remaining ink patterns as a mask, thereby obtaining desired patterns for a device.

As mentioned above, if printing patterns are formed by previously applying ink on the substrate and rotating the printing roll, which has convex patterns, across the substrate in a state that the printing roll is in contact therewith, some steps may be omitted, such as transferring ink patterns onto the printing roll from the cliché and re-transferring onto the substrate the patterns which have been transferred to the printing roll. For this reason, the accuracy can be improved as compared to the aforementioned case where the cliché is specially provided.

Also, since extra ink applied to regions at which the ink patterns are not to be formed is removed by the printing roll, the ink patterns of uniform thickness may remain on the entire substrate. Namely, in the previous pattern forming process (FIG. 3A to FIG. 3C), if pressure of the printing roll is not uniformly applied onto the substrate in the step of re-transferring ink patterns that have been transferred onto the printing roll to the substrate, the ink patterns formed on the substrate have non-uniform thickness. Particularly, because the printing roll should become larger as the substrate gets larger, in case of the large-sized substrate, the pressure of the printing roll applied to the substrate becomes more non-uniform.

The method for forming a pattern in accordance with the present invention described above will now be described in more detail with reference to accompanying drawings.

Figure 4A:
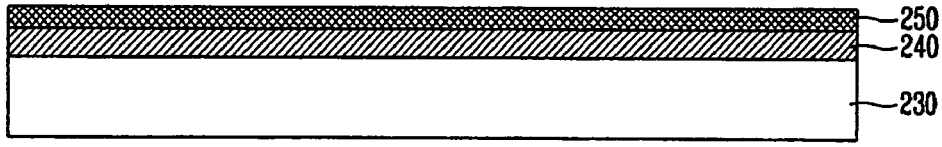
FIGS. 4A to 4D are views illustrating a method for forming a pattern in accordance with the present invention.

FIGS. 4A to 4D are views illustrating a method for forming a pattern in accordance with the present invention. First, as shown in FIG. 4A, an etching object layer 240 is formed on a substrate 230, and then ink 250 is applied thereto.

Figure 4B:
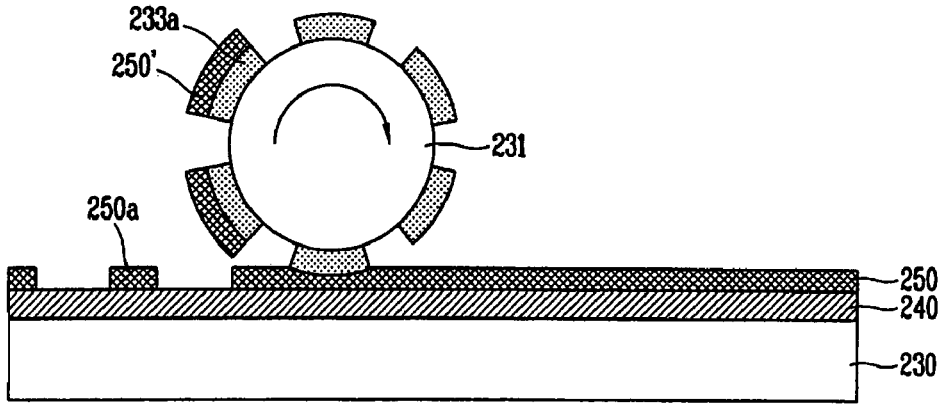

Then, as shown in FIG. 4B, the printing roll 231 contacts with the ink layer 250. In such a state, the printing roll 231 rotates across the ink layer, applying constant pressure thereto, such that ink patterns 250*a* are formed on the etching object layer 240. The pressure that the printing roll 231 applies to the ink layer 250 should be uniform. Convex patterns 233*a* are formed on a surface of the printing roll 231, and as the printing roll 231 proceeds such that its convex patterns 233*a* are in contact with the ink 250, the ink 250 is detached from the etching object layer 240 and becomes attached to the convex patterns 233*a*. Accordingly, ink patterns 250*a* remain on the etching object layer 240 at locations where the ink 250 does not contact with the convex patterns 233*a*.

In order to easily remove the ink 250 from the etching object layer 240 and to improve an adhesive force between the ink 250 and the convex patterns 233*a*, an adhesive force reinforcing agent may be applied to the surfaces of the convex patterns 233*a*. The adhesive force reinforcing agent may be, for example, HMDS (Hexa Methyl Disilazane).

Figure 4C:
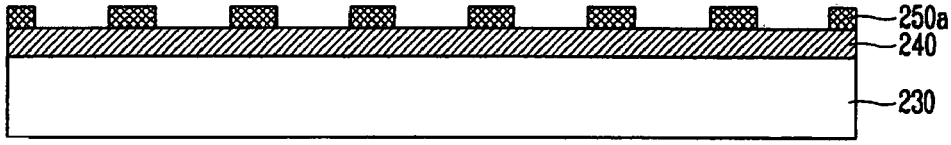

FIG. 4C illustrates ink patterns 250*a* formed on the etching object layer 240 through the process of FIG. 4B. The ink is removed at some regions of the etching object layer 240, which contact with the convex patterns of the printing roll, and the ink patterns 250*a* are formed at the other regions which do not contact with the convex patterns. Accordingly, some regions excluding the other regions where the ink patterns are formed have the same shape as the convex patterns of the printing roll.

The ink patterns 250*a* formed on the etching object layer 240 may be hardened by irradiating UV or heat thereto.

The etching object layer 240 may be a metal layer for forming a metal pattern such as a gate electrode, source/drain electrodes of a TFT, a gate line, a data line or a pixel electrode, or a semiconductor layer for forming an active layer. Also, the etching object layer 240 may be an insulating layer formed of, for example, SiOx or SiNx. In case of forming patterns for the display device, the ink patterns 250*a* function as a resist functions in a photolithography process. Accordingly, the ink patterns 250*a* are formed on the metal layer or the insulating layer, and then the metal layer or the insulating layer is etched by a general etching process, thereby forming a metal layer (i.e., electrode structure) or an insulating layer (e.g., contact hole) of a desired pattern.

Figure 4D:
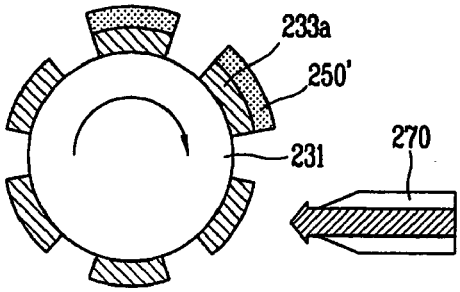

As shown in FIG. 4D, the ink 250' attached to the surfaces of the convex patterns 233*a* of the printing roll 231 may be removed by a cleaning solution dispensed from a washer 270. As examples of the cleaning solution, acetone, NMP (N-Methylpyrrolidone), or the like may be used.

As described above, in the present invention, the ink is applied onto the substrate on which a pattern is to be formed, and then the printing roll with the convex patterns moves across the surface of the ink, applying constant pressure thereto. In such a manner, the ink contacting with the convex patterns is detached from the substrate, thereby forming ink patterns at the remaining regions which do not contact with the convex patterns.

As mentioned above, the ink is applied onto the substrate and then the printing roll having the convex patterns rotates in contact with the ink, thereby forming ink patterns on the substrate. In this case, since the cliché is not used, the printing equipment may be simplified, and the step of transferring ink patterns onto the surface of the printing roll from the cliché may be omitted, thereby simplifying the printing process.

In addition, since ink is previously applied on the substrate, and ink that is applied to some regions where the ink patterns are not to be formed is removed by using the printing roll, the ink patterns of uniform thickness may be formed over the entire substrate.

The printing roll used in the present invention has convex patterns on its surface, and its fabrication method will now be described.

Figure 5A:
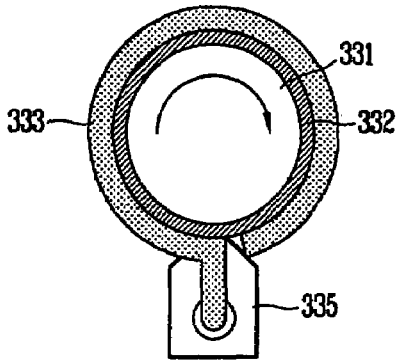
FIGS. 5A to 5C are views illustrating one example of a method for fabricating a print roll in accordance with the present invention.
Figure 5B:
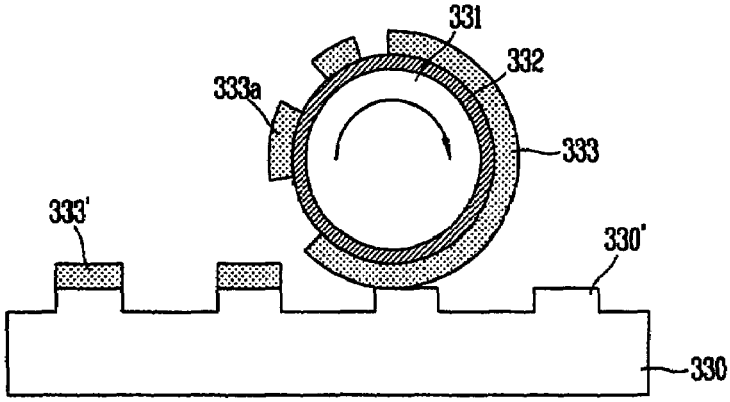
Figure 5C:
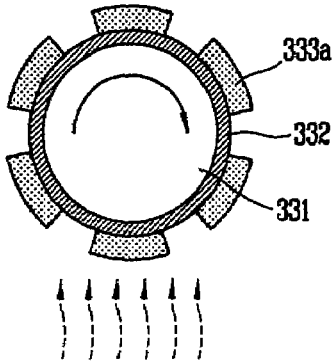

FIGS. 5A to 5C are views showing one method for fabricating a printing roll in accordance with the present invention.

First, as shown in FIG. 5A, a blanket 332 is formed on a surface of a cylindrical roll 331, and then an organic film 333 is applied onto a surface of the blanket 332 through an organic material supplier 335. As examples of the organic material, polyimide or BenzoCycloButene(BCB) may be used.

Then, as shown in FIG. 5B, a cliché 330 having a plurality of convex patterns 330' is provided, and the roll 331 to which the organic film 333 has been applied rotates across the cliché 330 in contact therewith, thereby forming organic patterns 333*a* on the surface of the blanket 332 which does not contact with the convex patterns 330' of the cliché 330. The cliché 330 having the plurality of convex patterns 330' may be formed by a photolithography process. Namely, a substrate of a glass material is provided, a metal film is deposited over an entire surface of the substrate, and patterning is performed thereon, thereby forming metal patterns. Then, the substrate is etched by using the metal patterns as a mask, thereby forming convex patterns 330' at the region where the metal patterns are formed. Here, the metal patterns may be removed. As the roll 331 to which the organic film 333 has been applied rotates across the surface of the cliché 330 fabricated by the aforementioned process, the organic film 333' contacting with the convex patterns 330' remains on the convex patterns 330'. Accordingly, the organic patterns 333*a* remain on the surface of the blanket 332 which does not contact with the convex patterns 330'.

Thereafter, as shown in FIG. 5C, the organic patterns 333*a* remaining on the surface of the blanket 332 may be UV-irradiated or heated to be hardened. As the organic patterns 333*a* are hardened, convex patterns are formed on the printing roll. Regions between the convex patterns respectively correspond to regions of the etching object layer where ink patterns are to be formed in a process of forming ink patterns. Namely, as illustrated through FIG. 4A to 4D, the ink patterns are formed at regions where the convex patterns do not contact with the ink of the substrate.

Figure 6A:
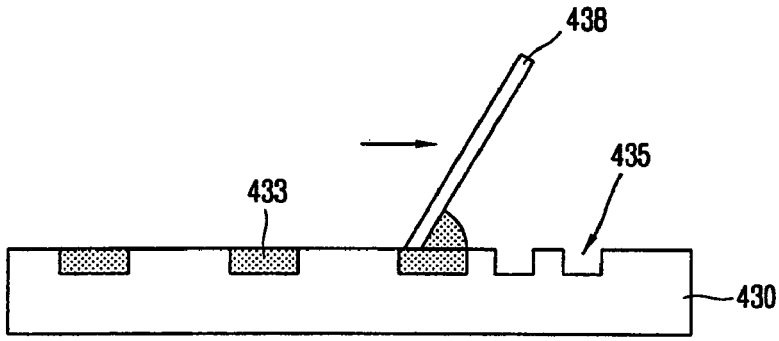
FIGS. 6A to 6C are views illustrating another example of a method of fabricating a print roll in accordance with the present invention.
Figure 6B:
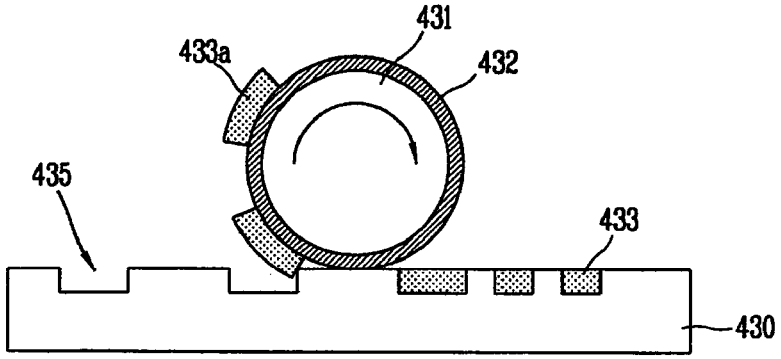
Figure 6C:
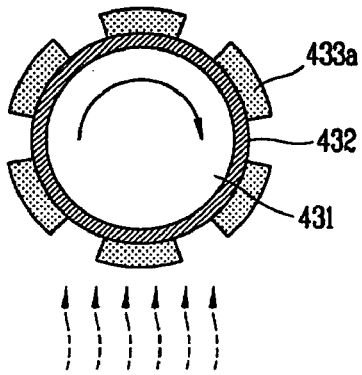

FIGS. 6A to 6C show another example of forming convex patterns on the printing roll. As shown in FIG. 6A, a cliché 430 having a plurality of recessed grooves 435 is provided, and then the grooves 435 are filled with an organic material 433. The grooves 435 of the cliché 430 are formed by a photolithography process, and the filling of the organic material 433 into the grooves 435 is made by applying a pattern forming organic material 433 to an upper portion of the cliché 430 and then pushing a doctor blade 438 across the surface of the cliché 430 in contact therewith. Accordingly, as the doctor blade 438 proceeds, the grooves 435 are filled with the organic material and simultaneously, the organic material remaining on the surface of the cliché 430 is removed.

Then, as shown in FIG. 6B, a cylindrical roll 431 having a blanket 432 around its surface rotates across the cliché 430 in contact therewith, such that the organic material 433 filled in the grooves 435 is transferred onto the surface of the blanket 432. In such a manner, organic patterns 433*a* are formed on the surface of the blanket 432.

Then, as shown in FIG. 6C, the organic patterns 433*a* transferred to the surface of the blanket 432 may be UV-irradiated or heated to be hardened. In such a manner, the organic patterns 433*a* are hardened, thereby forming convex patterns on the printing roll.

Figure 7A:
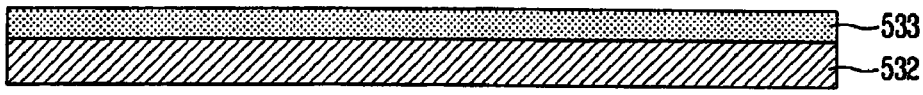
FIGS. 7A to 7E are views illustrating still another example of a method of fabricating a print roll in accordance with the present invention.

FIGS. 7A to 7E illustrate still another example of forming convex patterns on a printing roll. First, as shown in FIG. 7A, a resin plate 532 is provided, and then an organic film 533 is applied thereto. As examples of the organic film 533, polyimide, BenzoCycloButene, or the like may be used.

Figure 7B:
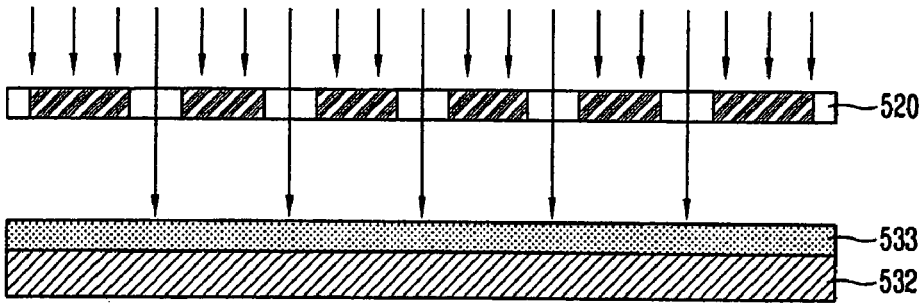
Figure 7C:
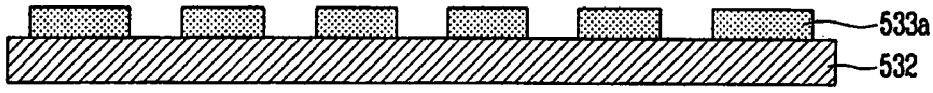

Then, as shown in FIG. 7B, light (illustrated as arrows in FIG. 7B) is selectively irradiated onto the organic film 533 through a mask 520 selectively having light transmission regions and light blocking regions. Then, as shown in FIG. 7C, upon operation of a developing solution, some regions of the organic layer where light has been irradiated are removed, and organic patterns 533*a* remain at the other regions where light has not been irradiated. The organic patterns 533*a* may be formed at some regions to which light has been irradiated depending on characteristics of the organic film 533. Namely, if the organic film 533 is a positive type, the organic film is removed at some regions to which light has been irradiated through the light transmission regions, and organic patterns are formed at the other regions to which light has not be irradiated. In contrast, in case of using a negative type organic film, organic patterns remain at some regions where light has been irradiated through the light transmission regions, and the organic film is removed by a developing solution at the other regions where light has not been irradiated. The organic patterns may be hardened by irradiating UV or heat thereto.

Figure 7D:
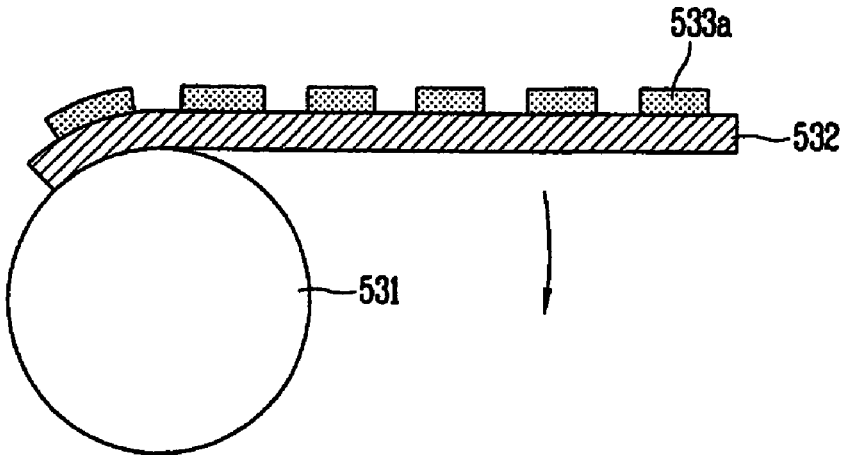
Figure 7E:
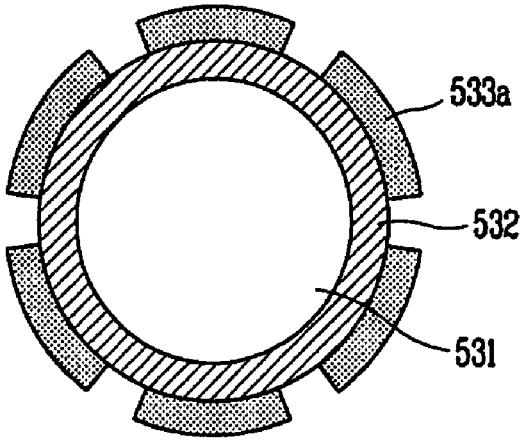

Then, as shown in FIG. 7D, a cylindrical roll 531 is provided, and the resin plate 532 is attached to the surface of the roll 531, exposing the organic patterns 533*a* toward the outside. Then, as shown in FIG. 7E, a printing roll having convex patterns is fabricated. The resin plate 532 should have a bending characteristic so as to be flexibly attached to the cylindrical roll 531.

As mentioned above, the convex patterns correspond to some regions excluding the other regions where ink patterns are to be substantially formed. Namely, since ink contacting with the convex patterns is detached from the substrate and is transferred onto the convex patterns, ink patterns remain only at the regions which do not contact with the convex patterns. Therefore, the surfaces of the convex patterns of the printing roll may be treated with an adhesive force reinforcing agent so that ink can be easily detached from the substrate and thus be easily attached to the convex patterns. As an example of the adhesive reinforcing agent, HMDS (Hexa MethylDisilazane) may be used.

As described so far, the present invention provides a method for forming patterns using a printing method, and particularly, a method for forming patterns so as to be capable of forming ink patterns of uniform thickness by using a printing roll having convex patterns.

Also, the method for forming patterns by the printing method in accordance with the present invention may be employed not only in the formation of active devices and circuits of display devices (e.g., LCD devices) but also in the formation of devices on semiconductor substrates.

As described above, in the present invention, ink is applied to a substrate, a printing roll having convex patterns proceeds across a surface of the ink applied to the substrate, providing constant pressure thereto. Thus, the ink contacting with the convex patterns may be removed and ink patterns may be formed on the substrate.

Also, in the present invention, since the use of a cliché is not necessary because of the use of a printing roll having convex patterns, printing equipment may be simplified. In addition, since the patterns are formed after ink is directly applied to the substrate, ink patterns of uniform thickness may be formed over the entire substrate.

Also, the present invention may improve production efficiency by simplifying the printing equipment and process.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for forming a pattern, comprising:

providing a printing roll having convex patterns thereon;

applying an ink onto an etching object layer; and forming ink patterns on the etching object layer as the printing roll rotates on the ink with the convex patterns in contact with the ink, wherein the step of providing the printing roll having the convex patterns, comprises:

providing a cylindrical roll having a blanket on its surface;

applying an organic film to a surface of the blanket;

providing a cliché having a plurality of convex patterns;

forming organic patterns on a blanket surface which does not contact with the convex patterns by rotating the roll after contacting the organic film on the blanket surface with the cliché; and hardening the organic patterns.

2. A method for forming a pattern, comprising:

providing a printing roll having convex patterns thereon;

applying an ink onto an etching object layer; and forming ink patterns on the etching object layer as the printing roll rotates on the ink with the convex patterns in contact with the ink, wherein the step of providing the printing roll having the convex patterns, comprises:

providing a cliché having a plurality of grooves;

applying an organic material onto the cliché;

filling the organic material into the grooves and simultaneously, removing the material remaining on the surface of the cliché by moving a doctor blade across the surface of the cliché;

transferring the organic material filled in the grooves onto a surface of a cylindrical roll; and hardening organic patterns transferred onto the surface of the roll.

3. A method for forming a pattern, comprising:

providing a printing roll having convex patterns thereon;

applying an ink onto an etching object layer; and forming ink patterns on the etching object layer as the printing roll rotates on the ink with the convex patterns in contact with the ink, wherein the step of providing the printing roll having the convex patterns, comprises:

applying an organic film onto a resin plate;

forming organic patterns by patterning the organic film;

hardening the organic patterns;

providing a cylindrical roll; and attaching the resin plate to the surface of the cylindrical roll, exposing the organic patterns.

4. The method of claim 3, wherein as the printing roll rotates, the ink applied to regions contacting with the projections of the printing roll is removed by being attached to the projections.

5. The method of claim 4, further comprising:

removing the ink attached to the projections.

6. The method of claim 5, wherein the ink is removed by acetone or N-Methylpyrrolidone.

7. The method of claim 3, wherein a surface of each projection of the printing roll is treated with an adhesive force reinforcing agent.

8. The method of claim 7, wherein the adhesive force reinforcing agent is Hexa Methyl Disilazane (HMDS).

9. The method of claim 3, wherein the etching object layer includes a metal layer.

10. The method of claim 3, wherein the etching object layer includes an insulating layer formed of SiOx or SiNx.

11. The method of claim 3, wherein the etching object layer is a semiconductor layer.

12. The method of claim 3, further comprising the step of hardening the ink patterns.

13. The method of claim 12, wherein the hardening the ink patterns comprises:

irradiating heat to the ink patterns.

14. The method of claim 12, wherein the hardening the ink patterns comprises:

irradiating UV onto the ink patterns.

15. The method of claim 3, further comprising:

etching the etching object layer by using the ink patterns as a mask.

* * * * *